US008425263B2

(12) United States Patent
Ju

(10) Patent No.: US 8,425,263 B2
(45) Date of Patent: Apr. 23, 2013

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 186 days.

(21) Appl. No.: 13/183,213

(22) Filed: Jul. 14, 2011

(65) Prior Publication Data

US 2012/0270451 A1 Oct. 25, 2012

(30) Foreign Application Priority Data

Apr. 20, 2011 (CN) ..... 2011 2 0122668 U

(51) Int. Cl.
*H01R 9/22* (2006.01)

(52) U.S. Cl.
USPC ..... 439/709

(58) Field of Classification Search ..... 439/709, 439/701, 70–73, 331, 862, 66–67
See application file for complete search history.

(56) References Cited

U.S. PATENT DOCUMENTS

| | | | | |
|---|---|---|---|---|
| 6,178,629 | B1 * | 1/2001 | Rathburn | 29/843 |
| 6,231,353 | B1 * | 5/2001 | Rathburn | 439/66 |
| 6,921,271 | B2 * | 7/2005 | Liao et al. | 439/66 |
| 7,214,069 | B2 * | 5/2007 | Rathburn | 439/66 |
| 7,297,010 | B2 * | 11/2007 | Tsai | 439/331 |
| 7,563,107 | B2 * | 7/2009 | Liao et al. | 439/71 |
| 7,909,617 | B2 * | 3/2011 | Liao et al. | 439/71 |

* cited by examiner

*Primary Examiner* — Jean F Duverne
(74) *Attorney, Agent, or Firm* — Morris Manning & Martin LLP; Tim Tingkang Xia, Esq.

(57) ABSTRACT

An electrical connector for electrically connecting a chip module to a circuit board includes: an insulating body, provided with a plurality of receiving holes; at least one raised portion, raised on an upper surface of the insulating body, for supporting the chip module at positions without contact pads in the chip module; a metal layer, plated on inner walls of the receiving holes and the upper surface of the insulating body; an insulating layer, disposed to cover the metal layer; and a plurality of terminals, respectively correspondingly received in the receiving holes, each terminal having a contact portion exposed above the receiving hole for conducting to the chip module. When the chip module presses the contact portions downwards, the raised portion urges against the chip module, so as to prevent the chip module from damaging the insulating layer and conducting to the metal layer to cause short circuit.

10 Claims, 5 Drawing Sheets

ELECTRICAL CONNECTOR

CROSS-REFERENCE TO RELATED APPLICATIONS

This non-provisional application claims priority under 35 U.S.C. §119(a) on Patent Application No. 201120122668.5 filed in China on Apr. 20, 2011, the entire contents of which are hereby incorporated by reference.

FIELD OF THE INVENTION

The present invention relates to an electrical connector, and more particularly to an electrical connector for electrically connecting a chip module to a circuit board.

BACKGROUND OF THE INVENTION

In a conventional Land Grid Array (LGA) electrical connector for electrically connecting a chip module, raised portions are disposed on a connector body corresponding to terminals, and the raised portions support the chip module, so as to prevent the chip module from bending deformation when being pressed, for example, as disclosed in U.S. Pat. No. 7,563,107 and U.S. Pat. No. 7,909,617. Raised portions may also be respectively disposed on upper and lower surfaces of the connector body, and the raised portions support pads on the chip module or the circuit board, so as to prevent pads on the chip module or PCB from accidentally contacting the retention portions of the terminals, for example, as disclosed in U.S. Pat. No. 6,921,271. In the prior arts, the raised portion is disposed corresponding to each terminal, and as the terminal spacing increasingly decreases along with the pin pitch of the chip module, the size of the raised portion becomes extremely small, so that the strength of each raised portion cannot be ensured. Once the force exerted by the chip module on the raised portions is not balanced, and one raised portion bears a larger force, the raised portion bearing the larger force may be deformed or broken.

In addition, with the increasingly higher working frequency of the chip module and increasingly greater influence caused by noises, it is necessary to dispose an electromagnetic shielding layer to isolate noises. The inventor has proposed a technology of plating a conductive layer on the connector body for electromagnetic shielding and disposing an insulating layer on the conductive layer. However, when the electromagnetic shielding technology is applied to the connector with raised portions, the insulating layer on the raised portion is easily damaged when urging against the chip module, leading to undesired conduction of the conductive layer with the chip module and further causing short circuit. As a result, the technology cannot achieve electromagnetic shielding while avoiding deformation of the chip module.

Therefore, a heretofore unaddressed need exists in the art to address the aforementioned deficiencies and inadequacies.

SUMMARY OF THE INVENTION

In one aspect, the present invention is directed to an electrical connector that can achieve supporting and shielding effects without causing short circuit of the chip module.

In one embodiment, the present invention provides an electrical connector for electrically connecting a chip module to a circuit board. The electrical connector includes: an insulating body, provided with a plurality of receiving holes; at least one raised portion, raised on an upper surface of the insulating body, for supporting the chip module at positions without contact pads in the chip module; a metal layer, plated on inner walls of the receiving holes and the upper surface of the insulating body; an insulating layer, disposed to cover the metal layer; and a plurality of terminals, respectively received in the receiving holes, each terminal having a contact portion exposed above the receiving hole for conducting the chip module and a soldering portion located at a lower end of the terminal for conducting to the circuit board.

The raised portions may support the chip module at the positions without contact pads in the chip module, so that no undesired conduction will be caused even if the insulating layer covering the shielding layer on the raised portions is damaged. A periphery of the upper surface of the insulating body may also be raised upwards to form an upper circumferential wall, which forms an accommodating space for accommodating the chip module, so as to improve the accuracy of relative positions of the chip module and the connector, thereby ensuring that the raised portions support the chip module at the positions without contact pads in the chip module. The electromagnetic shielding layer may also not be disposed on the raised portions, so that even if the chip module presses or scrapes the upper surfaces of the raised portions, the problem of undesired conduction due to damage to the insulating layer does not need to be taken into consideration, as no conductive electromagnetic shielding layer exists on the upper surfaces.

Moreover, it is not necessary to dispose the raised portions corresponding to each terminal, so that although the terminal spacing increasingly decreases, it is not necessary to sacrifice the strength of the raised portion for adapting to the decrease of the terminal spacing. Further, supporting portions may be disposed on the lower surface of the insulating body and right below the raised portions, so that when the raised portions support the chip module, the supporting portions directly support the insulating body from right below the raised portions, so as to prevent the raised portions from losing the function of supporting the chip module due to deformation of the insulating body.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
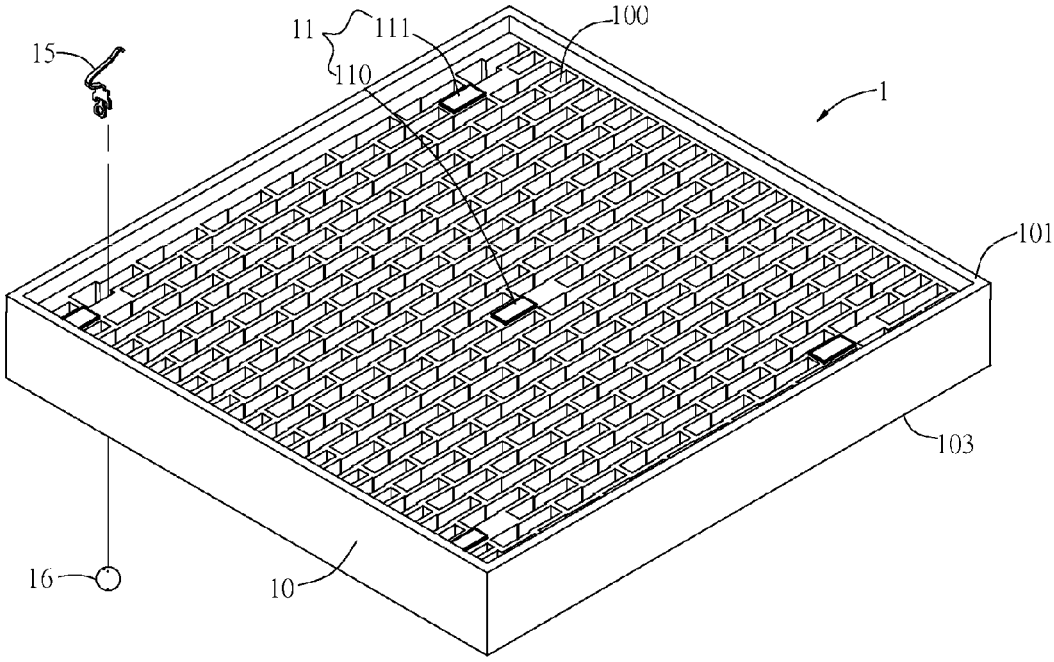
FIG. 1 is a three-dimensional exploded view of an electrical connector in one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 2:
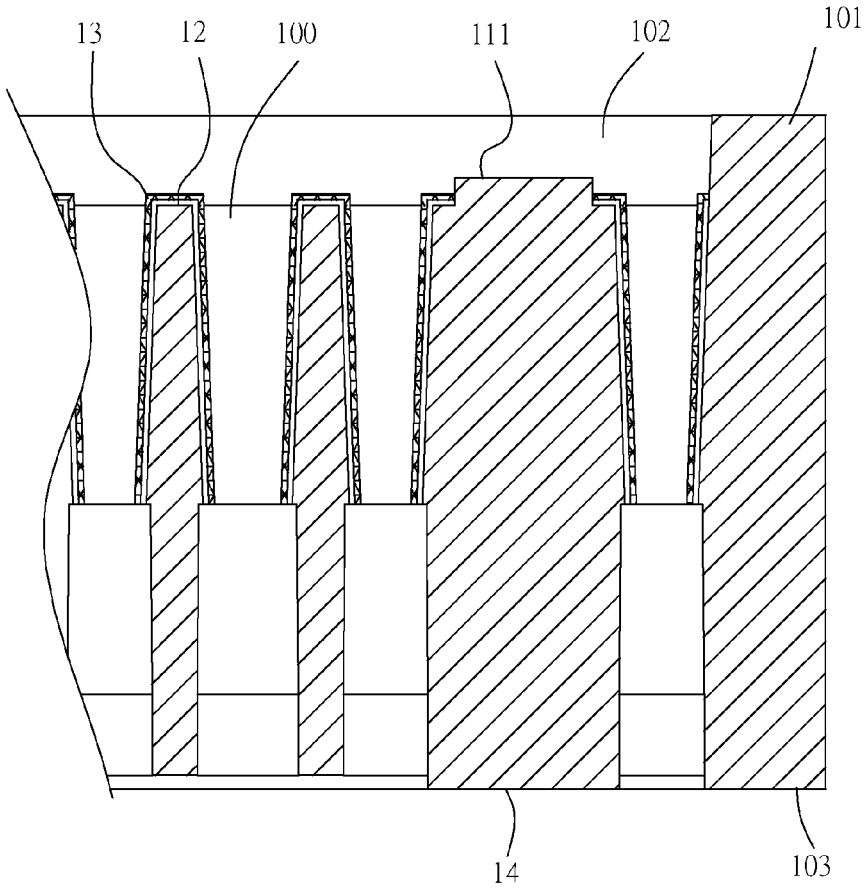
FIG. 2 is a schematic sectional view of an insulating body of the electrical connector in one embodiment of the present invention.
Figure 5:
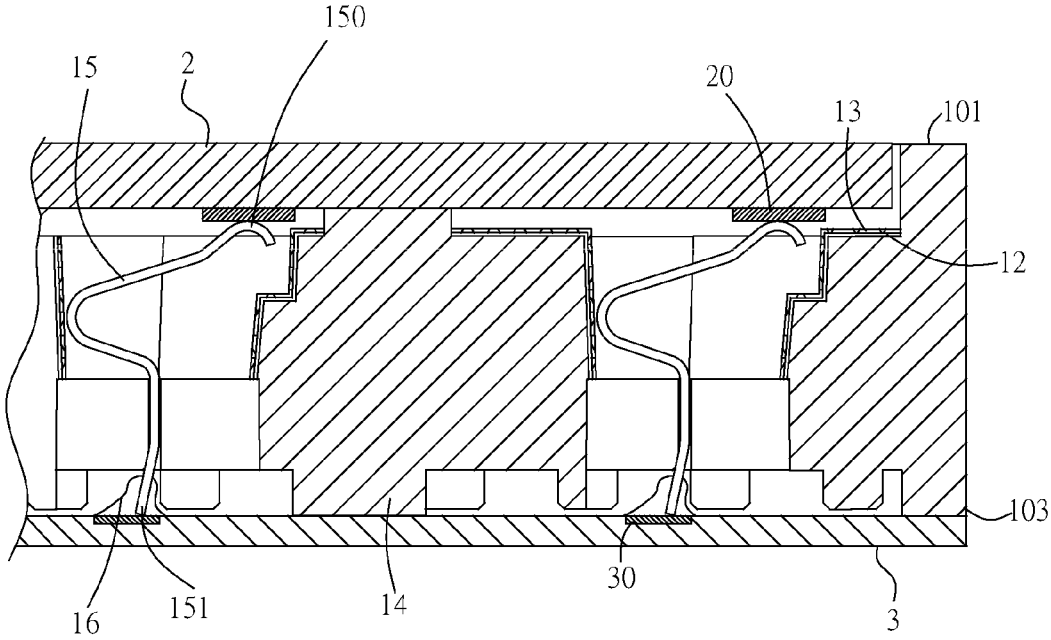
FIG. 5 is a schematic view of the electrical connector in one embodiment of the present invention mounted with a chip module.

Referring to FIG. 1, FIG. 2 and FIG. 5, the electrical connector 1 of the present invention is used for electrically connecting a chip module 2 to a circuit board 3. The electrical connector 1 includes an insulating body 10 located below the chip module 2. A plurality of receiving holes 100 are formed through the insulating body 10. An upper surface of the insulating body 10 is raised to form five raised portions 11 for supporting the chip module 2. A metal layer 12 is plated on inner walls of the receiving holes 100 and the upper surface of the insulating body 10. An insulating layer 13 is disposed to cover the metal layer 12. A lower surface of the insulating body 10 is raised downwards to form five supporting portions 14. A plurality of terminals 15 are respectively received in the receiving holes 100. A plurality of solder balls 16 are disposed respectively corresponding to the receiving holes 100 and the terminals 15.

Referring to FIG. 1, FIG. 2 and FIG. 5, the insulating body 10 is a square plastic insulator formed by injection molding. A periphery of the upper surface of the insulating body 10 is raised upwards to form an upper circumferential wall 101 higher than the raised portions 11, and the upper circumferential wall 101 forms an accommodating space 102. The accommodating space 102 is used for accommodating and positioning the chip module 2, to ensure the accuracy of relative positions of the chip module 2 and the electrical connector 1, so that the raised portions 11 of the electrical connector 1 support the chip module 2 at positions without contact pads 20 in the chip module 2. Below the chip module 2, the upper surface of the insulating body 10 is raised upwards to form five raised portions 11 lower than the upper circumferential wall 101. The five raised portions 11 include a first raised portion 110 and four second raised portions 111. The first raised portion 110 is located at the center of the upper surface of the insulating body 10, and the four second raised portions 111 are disposed surrounding the first raised portion 110 and symmetrically distributed relative to the first raised portion 110. When the chip module 2 presses the terminals 15 downwards, the first raised portion 110 and the four second raised portions 111 jointly urge against a lower surface of the chip module 2 to support the chip module 2, so as to prevent deformation due to excessive downward pressing of the chip module 2. In other embodiments (not shown), the number of the raised portions 11 may be one or more.

Referring to FIG. 1, FIG. 2 and FIG. 5, a periphery of the lower surface of the insulating body 10 is raised downwards to form a lower circumferential wall 103, and the lower circumferential wall 103 urges against the circuit board 3 to support the electrical connector 1. The lower surface of the insulating body 10 is raised downwards to form five supporting portions 14, and the five supporting portions 14 are respectively located right below the five raised portions 11. In other words, horizontal projections of the five supporting portions 14 respectively overlap the five raised portions 11. The five supporting portions 14 are at the same height as the lower circumferential wall 103, and thus can urge against the circuit board 3 together with the lower circumferential wall 103, so as to provide better support for the electrical connector 1. In other embodiments (not shown), the number of the supporting portions 14 may be one or more.

Figure 3:
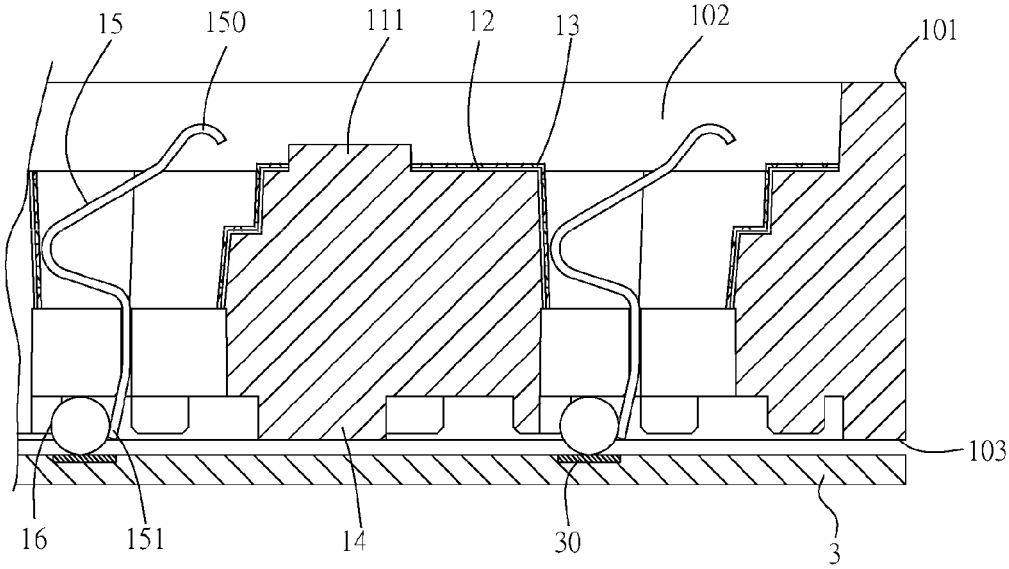
FIG. 3 is a schematic view of the electrical connector in one embodiment of the present invention disposed on a circuit board.

Referring to FIG. 2 and FIG. 3, the metal layer 12 is plated on the upper surface of the insulating body 10 and the inner walls of the receiving holes 100. The metal layer 12 provides electromagnetic shielding for the terminals 15 to prevent signal interference between the terminals 15, and the metal layer 12 is conducted with a grounding sheet (not shown), so as to ground the metal layer 12 through the grounding sheet (not shown). The insulating layer 13 is disposed on the metal layer 12 to cover the metal layer 12, and the insulating layer 13 insulates the metal layer 12 from other elements. To prevent short circuit of the chip module 2 once the insulating layer 13 on the raised portions 11 is damaged to expose the metal layer 12, a mask or other methods may be adopted to prevent the metal layer 12 from covering upper surfaces of the raised portions 11 during the process of plating the metal layer 12.

Figure 4:
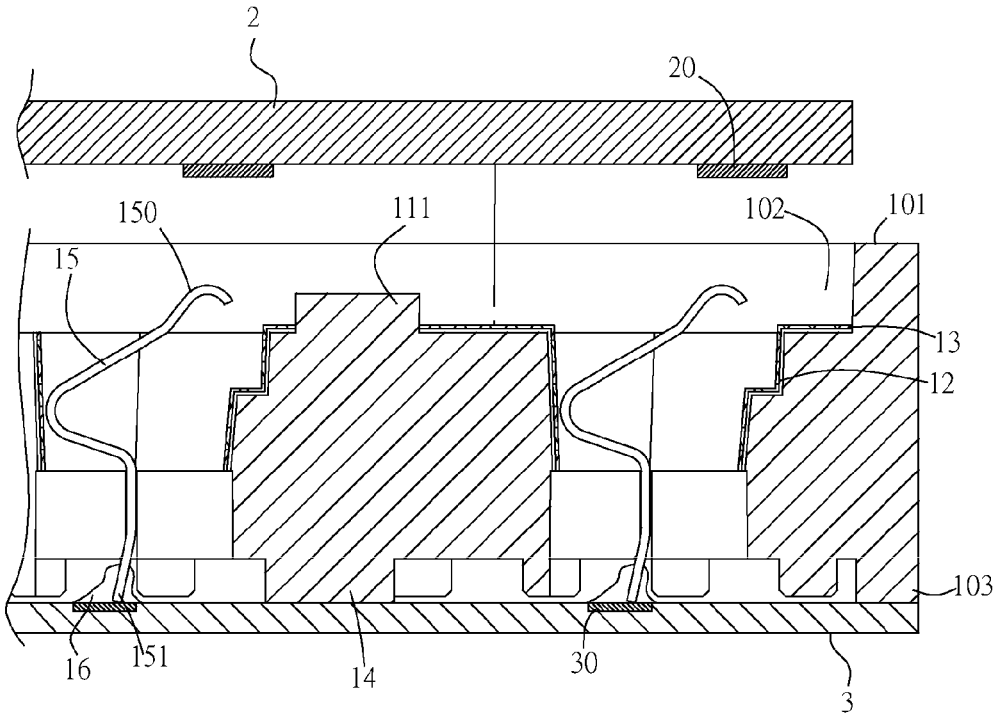
FIG. 4 is a schematic view of the electrical connector in one embodiment of the present invention soldered onto a circuit board.

Referring to FIG. 1, FIG. 3 and FIG. 4, the terminals 15 are correspondingly received in the receiving holes 100. Each terminal 15 includes a contact portion 150 located at an upper end thereof and exposed out of the receiving hole 100 and a soldering portion 151 located at a lower end thereof. The contact portion 150 contacts the chip module 2 in a press-fit manner so as to achieve the electrical connection between the terminal 15 and the chip module 2, and the soldering portion 151 is soldered onto the circuit board 3 so as to achieve the electrical connection between the terminal 15 and the circuit board 3.

Referring to FIG. 1, FIG. 3 and FIG. 4, among the solder balls 16, one solder ball 16 is disposed corresponding to each receiving hole 100 and each soldering portion 151, and the solder ball 16 electrically connects the soldering portion 151 to the circuit board 3.

Referring to FIG. 3 to FIG. 5, the chip module 2 includes a plurality of raised contact pads 20 for being respectively correspondingly press-fit to the contact portions 150, so that the electrical connector 1 is electrically connected to the chip module 2, and the chip module 2 transmits electrical signals to the electrical connector 1. When the contact pads 20 of the chip module 2 respectively contact the corresponding contact portions 150, the contact pads 20 are higher than the upper surface of the insulating body 10, for prevent the contact pads 20 from urging against the upper surface of the insulating body 10, so as to prevent the contact pads 20 from urging against the upper surface of the insulating body 10.

Referring to FIG. 4 and FIG. 5, the circuit board 3 includes a plurality of solder joints 30 disposed thereon. Each solder joint 30 is correspondingly soldered to each soldering portion 151, so that the electrical connector 1 is electrically connected to the circuit board 3, and the electrical connector 1 transmits electrical signals to the circuit board 3.

Referring to FIG. 3, FIG. 4 and FIG. 5, the main process of electrically connecting the chip module 2 to the circuit board 3 through the electrical connector 1 is as follows.

First, the electrical connector 1 is placed on the circuit board 3. At this time, the solder balls 16 respectively urge against the solder joints 30, and the supporting portions 14 and the lower circumferential wall 103 do not urge against the circuit board 3.

Then, the solder balls 16 are soldered onto the solder joints 30. At this time, the solder balls 16 are melted, the electrical connector 1 undergoes a downward displacement, and the supporting portions 14 and the lower circumferential wall 103 urge against the circuit board 3. In this way, the supporting portions 14 and the lower circumferential wall 103 jointly support the electrical connector 1.

Finally, the chip module 2 is mounted onto the electrical connector 1. The chip module 2 presses the contact portions 150 and undergoes a downward displacement together with the contact portions 150, so that the chip module 2 urges against the first raised portion 110 and the second raised portions 111.

Based on the above, the electrical connector 1 of the present invention, among other things, has the following beneficial effects.

1. When the electromagnetic shielding technology of plating the metal layer 12 and disposing the insulating layer 13 as proposed by the inventor is applied to the connectors with raised portions in the prior art, electromagnetic shielding can be achieved while avoiding deformation of the chip module 2. Moreover, the raised portions 11 are arranged to support the chip module 2 at the positions without contact pads 20 in the chip module 2, so as to prevent the insulating layer 13 from being damaged by the chip module 2 to cause short circuit. The periphery of the upper surface of the insulating body 10 may be raised upwards to form an upper circumferential wall 101, which forms an accommodating space 102 for accommodating the chip module 2, so as to improve the accuracy of relative positions of the chip module 2 and the connector 1, thereby ensuring that the raised portions 11 can support the chip module 2 at the positions without contact pads 20 in the chip module 2. Further, the metal layer 12 may be configured to not cover the upper surfaces of the raised portions 11, so that even if displacement occurs, the problem of short circuit due to damage to the insulating layer 13 does not need to be taken into consideration, as no conductive electromagnetic shielding layer exists on the upper surfaces of the raised portions 11.

2. The number of the raised portions 11 is less than that of the terminals 15, so that it is not necessary to sacrifice the strength of the raised portions 11 along with the decrease of the terminal spacing. Further, the supporting portions 14 may be disposed corresponding to the raised portions 11, to support the insulating body 10 from right below the raised portions 11, so as to prevent the raised portions 11 from losing the function of supporting the chip module 2 due to deformation of the insulating body 10, which can surely provide reliable support for the chip module 2.

3. When the contact pads 20 of the chip module 2 respectively contact the corresponding contact portions 10, the contact pads 20 are higher than the upper surface of the insulating body 10, so as to prevent the contact pads 20 from urging against the upper surface of the insulating body 10, thereby further preventing undesired short circuit.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting a chip module having a plurality of raised contact pads to a circuit board comprising:

(a) an insulating body, provided with a plurality of receiving holes;

(b) at least one raised portion, raised on an upper surface of the insulating body, for supporting the chip module at positions without contact pads in the chip module;

(c) a metal layer, plated on inner walls of the receiving holes and the upper surface of the insulating body;

(d) an insulating layer, disposed to cover the metal layer; and (e) a plurality of terminals, respectively received in the receiving holes, each terminal having a contact portion exposed above the receiving hole for conducting to the contact pads of the chip module and a soldering portion located at a lower end of the terminal for conducting to the circuit board.

2. The electrical connector according to claim 1, wherein the metal layer does not cover an upper surface of the raised portion.

3. The electrical connector according to claim 1, wherein a periphery of the upper surface of the insulating body is raised upwards to form an upper circumferential wall higher than the raised portion, and the upper circumferential wall forms an accommodating space for accommodating the chip module.

4. The electrical connector according to claim 1, wherein a lower surface of the insulating body is raised downwards to form at least one supporting portion, and the supporting portion urges against the circuit board.

5. The electrical connector according to claim 3, wherein horizontal projections of the raised portion and the supporting portion overlap.

6. The electrical connector according to claim 4, wherein a periphery of the lower surface of the insulating body is raised downwards to form a lower circumferential wall, and the lower circumferential wall and the supporting portion jointly urge against the circuit board.

7. The electrical connector according to claim 1, wherein the raised portion comprises:

a first raised portion disposed at the center of the upper surface of the insulating body; and a plurality of second raised portions disposed surrounding the first raised portion, wherein the first raised portion and the second raised portions jointly support the chip module.

8. The electrical connector according to claim 6, wherein the second raised portions are symmetrically distributed relative to the first raised portion.

9. The electrical connector according to claim 1, when the contact pads of the chip module respectively contact the corresponding contact portions, the contact pads are higher than the upper surface of the insulating body, for prevent the contact pads from urging against the upper surface of the insulating body.

10. The electrical connector according to claim 1, wherein the number of the raised portions is less than that of the terminals.

* * * * *